United States Patent [19]

Kohnen

[11] Patent Number: 4,797,523

[45] Date of Patent: Jan. 10, 1989

[54] COVER FOR AN OPEN CONTAINER, WHOSE CONTENT IS TO BE HEATED IN A MICROWAVE OVEN

[76] Inventor: Friederun Kohnen, Untere Heide 6a, 4322 Sprockhovel, Fed. Rep. of Germany

[21] Appl. No.: 897,998

[22] Filed: Aug. 19, 1986

[30] Foreign Application Priority Data

Aug. 22, 1985 [DE] Fed. Rep. of Germany ..... 3530008

[51] Int. Cl.[4] ..... H05B 6/80; B65D 65/02

[52] U.S. Cl. ..... 219/10.55 E; 426/107; 426/243; 150/52 R; 219/10.55 M

[58] Field of Search ..... 219/10.55 E, 10.55 R, 219/10.55 M; 264/22; 156/244.23; 428/520; 525/93, 212; 426/107, 243, 105; 150/52 R

[56] References Cited

U.S. PATENT DOCUMENTS 2,495,435 1/1950 Welch ..... 219/10.55 R
3,587,447 6/1971 Larkin ..... 99/425
4,015,085 3/1977 Woods ..... 219/10.55 E
4,248,595 2/1981 Lask et al. ..... 8/120
4,367,312 1/1983 Bontinck et al. ..... 156/244.23
4,410,011 10/1983 Andrä426 ..... 105/
4,486,507 12/1984 Schomacher ..... 428/476.1

FOREIGN PATENT DOCUMENTS 2109188 5/1972 France .
1191518 11/1967 United Kingdom .

OTHER PUBLICATIONS

Microwave Cookery, Richard Deacon, H. P. Books 1977, p. 9 last Para.

*Primary Examiner*—Philip H. Leung
*Assistant Examiner*—Leon K. Fuller
*Attorney, Agent, or Firm*—Cushman, Darby & Cushman

[57] ABSTRACT

A cellulose hydrate film, having ventilation holes, for use in covering otherwise open topped containers of various sizes and shapes, in which the contents are to be heated in a microwave oven.

8 Claims, 1 Drawing Sheet

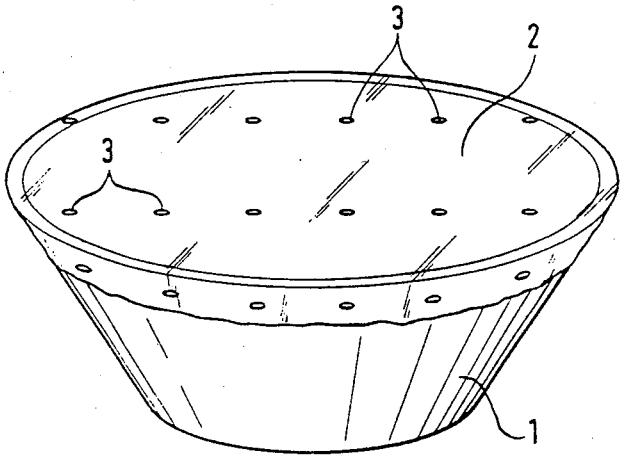
3
2
3
1

COVER FOR AN OPEN CONTAINER, WHOSE CONTENT IS TO BE HEATED IN A MICROWAVE OVEN

The present invention relates to a cover for use on an open container for particularly closing same, where the contents of the container are to be heated in a microwave oven, as well as to a process for covering such a container.

It is already known to use a glass or similar cover on otherwise open containers, when the contents are to be heated, such as in a microwave oven. This prevents splashing, loss of moisture and prevents drying of the upper layer of the contents all or some of which might otherwise occur as a result of the heating action. However, the shape of such a glass cover must be specifically adapted to a particular container with which it is to be used and must assume a stable position on the latter. Further, it is not possible to sensibly provide a wide variety glass covers to cover a series of randomly shaped containers.

The present invention relates to a way to provide a suitable cover for randomly shaped, open containers thereby making it possible to heat the container's contents in a microwave oven.

According to the invention this objective is solved by a cover formed from a cellulose hydrate film having a plurality of spaced apart ventilation holes therein, and by using a cellulose hydrate film that preferably is transparent.

Such a cellulose hydrate film can be particularly adequately and simply fitted to the open and generally dish-shaped or pot-shaped container, e.g. by moistening the cellulose hydrate film, placing it over the container opening and pressing it against the opening rim, as well as to the adjacent outer surface region of the container wall, so that it adheres to the container and at least a portion of the side wall thereof, and is not blown down into the container or off the container by the air flow produced by any microwave oven fan. The film is dried when heated by microwave radiation and will be stretched over the container opening, whilst simultaneously the air expanding within the container, as a result of the heat action can escape through the ventilation holes.

The choice of a cellulose hydrate film as the cover removes all the problems resulting from other film or flexible type covers. Polyethylene films, for example, are not suitable for covering containers to be heated in microwave ovens, because they are softened by the microwave radiation and they can allow gases to escape therefrom. Paper, which is apparently suitable for use in a microwave oven, is on the one hand not transparent, i.e. does not make it possible to see the container content, and on the other hand cannot be adequately fixed to the container in a simple manner so as to ensure that it is not blown away by air currents produced by a microwave fan.

The present invention is explained in greater detail hereinafter relative to the drawing. The single FIGURE shows an open container 1, which is for example, made from glass, or porcelain. While a tapered open bowl is shown, this is merely representative of a wide variety of containers and shapes are contemplated as being included. The container opening is closed by a cellulose hydrate film 2, which adheres to the rim and the outer circumferential surface of container 1. For this purpose, the cellulose hydrate film 2, having been moistened and being sized so as to be larger than the container's outer diameter or largest dimension so that it will extend over and downwardly along at least a portion of the container's side walls, is placed over the opening of container 1 and is then pressed onto the rim and the outer surface.

As shown, the cellulose hydrate film has a plurality of spaced apart holes 3, through which expanding, heated air can escape. The cellulose hydrate film may e.g. be Cellophan film with a thickness of 20 about μm such as that manufactured by Wolff Walsrode- AG, to which film no paint or varnish has been applied and in which holes are made at about 25 mm intervals by means of a needle roller.

I claim:

1. A cover for an open container in which material therein is to be heated in a microwave oven, characterized in that the cover is made from a cellulose hydrate film including means defining ventilation holes therein.

2. A cover according to claim 1, wherein the cellulose hydrate film is transparent.

3. A cover as in claim 1 wherein the cover is dementioned so as to be larger than an upper peripheral opening defined by the walls of a container with which it is used whereby in use the cover is contact with at least a portion of the walls of the container with which it is used.

4. A cover as in claim 1 wherein the film thickness is about 20 μm.

5. A cover as in claim 1 wherein the hole means are spaced apart at about 25 mm intervals.

6. A process for covering the contents of an open container to be used in a microwave oven including the steps of moistening at least a portion of a cellulose hydrate film having a plurality of spaced apart ventilation holes therein, placing the film over the container opening so that the moistened portion is in contact with the container and so that the ventilation openings are positioned over the opening in the open container and pressing the film onto the opening rim, and onto the outer surface area of the adjacent container wall.

7. A cover as in claim 1, wherein the cellulose hydrate film is an uncoated film.

8. A cover for an open container in which material us to be heated in a microwave oven, characterized in that the cover consists essentially of a cellulose hydrate film including means defining ventilation holes therein.

* * * * *